US011583744B1

(12) United States Patent
Hayes

(10) Patent No.: US 11,583,744 B1
(45) Date of Patent: Feb. 21, 2023

(54) SYSTEM FOR ABSORBING AND REDIRECTING IMPACT

(71) Applicant: William Hayes, Coral Gables, FL (US)

(72) Inventor: William Hayes, Coral Gables, FL (US)

( * ) Notice: Subject to any disclaimer, the term of this patent is extended or adjusted under 35 U.S.C. 154(b) by 0 days.

(21) Appl. No.: 17/471,391

(22) Filed: Sep. 10, 2021

(51) Int. Cl.
*A63B 69/20* (2006.01)
*A63B 71/00* (2006.01)

(52) U.S. Cl.
CPC ..... *A63B 69/20* (2013.01); *A63B 2071/0063* (2013.01)

(58) Field of Classification Search
CPC . A63B 69/20; A63B 2071/0063; A63B 59/00; A63B 67/00; A63B 71/145; F16F 1/374; F16F 1/373; F16F 1/44; F16F 1/445
USPC ..... 267/140, 153
See application file for complete search history.

(56) References Cited

U.S. PATENT DOCUMENTS

2004/0220021 A1 11/2004 Bryant
2014/0005018 A1* 1/2014 Palmer ..... A63B 69/0093 482/142
2014/0148314 A1 5/2014 Schlicher
2015/0209641 A1* 7/2015 Yevgeniyovych ..... A63B 69/20 482/83
2022/0212076 A1* 7/2022 Rita ..... A63B 69/004

FOREIGN PATENT DOCUMENTS

WO WO-2015181569 A1 * 12/2015 ..... A63B 60/40

* cited by examiner

*Primary Examiner* — Jennifer Robertson
*Assistant Examiner* — Jacqueline N L Loberiza
(74) *Attorney, Agent, or Firm* — Sanchelima & Associates, P.A.; Christian Sanchelima; Jesus Sanchelima

(57) ABSTRACT

A system for absorbing and redirecting impact including a plates assembly and a damping assembly is disclosed herein. The plates assembly includes a first plate being attached to a wall. The first plate and a second plate having a plurality of openings. The openings receive straps to tether the second plate to the first plate. The damping assembly includes a padding being attached to a front side of the second plate. A plurality of angled members are attached to a rear side of the second plate and to a front side of the first plate. The plurality of angled members receive shock absorbers therein. The damping assembly is configured to absorb and redirect impacts.

12 Claims, 4 Drawing Sheets

SYSTEM FOR ABSORBING AND REDIRECTING IMPACT

BACKGROUND OF THE INVENTION

1. Field of the Invention

The present invention relates to a system for absorbing and redirecting impacts and, more particularly, to a system for absorbing and redirecting impacts that includes plates having shock absorbers therebetween. The shock absorbers are unattached to the system but have a limited rotation, a limited deformation and a limited displacement to absorb and dissipate energy of an impact.

2. Description of the Related Art

Several designs for a system for absorbing and redirecting impacts have been designed in the past. None of them, however, include a system comprising wall mounting plates having shock absorbers therebetween.

Applicant believes that a related reference corresponds to U.S. patent No. 20140148314A1 issued for a striking apparatus including a spring assembly and of pads that may receive strikes from a user. Applicant believes that another related reference corresponds to U.S. patent No. 20040220021A1 issued for a martial arts practice apparatus comprising a punching and kicking pad secured by spring-loaded connectors to a board to which is also attached a timing light that blinks intermittently at irregular intervals. None of these references, however, teach of a system for absorbing and redirecting impacts comprising wall mounted plates having angle members to receive shock absorbers therebetween, wherein the shock absorbers can dissipate energy from impacts.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a system for absorbing and redirecting impacts that can be mounted to a wall.

It is another object of this invention to provide a system for absorbing and redirecting impacts that can be punched by a user to train for fighting sports.

It is still another object of the present invention to provide a system for absorbing and redirecting impacts that can be easily manufactured and installed.

It is still another object of the present invention to provide a system for absorbing and redirecting impacts that includes shock absorbers that can be easily replaced to change the damping characteristics of the present invention without the necessity of disassemble the present invention.

It is still another object of the present invention to provide a system for absorbing and redirecting impacts that can be manufactured utilizing reused materials and recycled materials.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
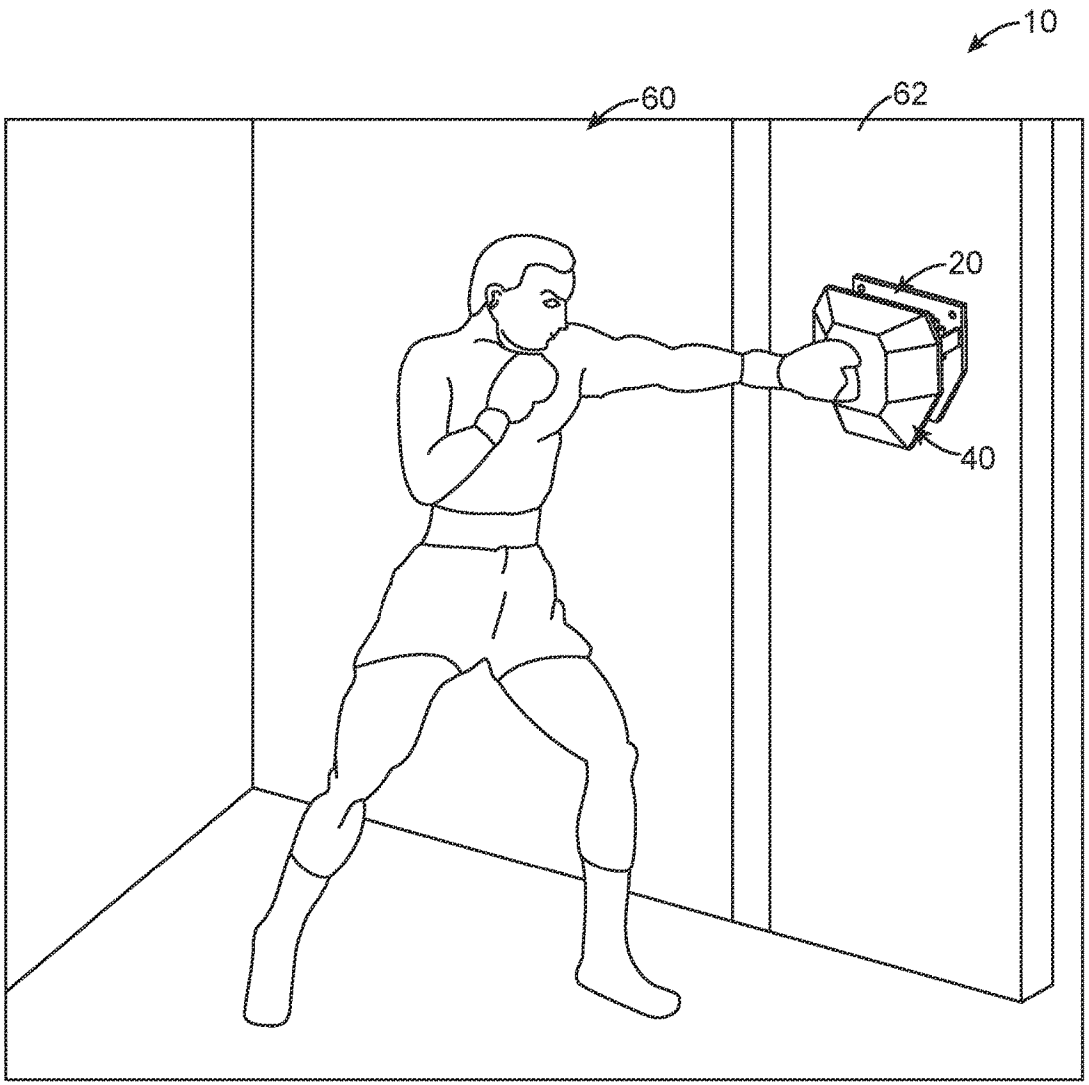
FIG. 1 represents an isometric operational view of the present invention 10. A plates assembly 20 is attached to a wall 62 of a wall assembly 60. A damping assembly 40 is absorbing energy from an impact of a user.
Figure 2:
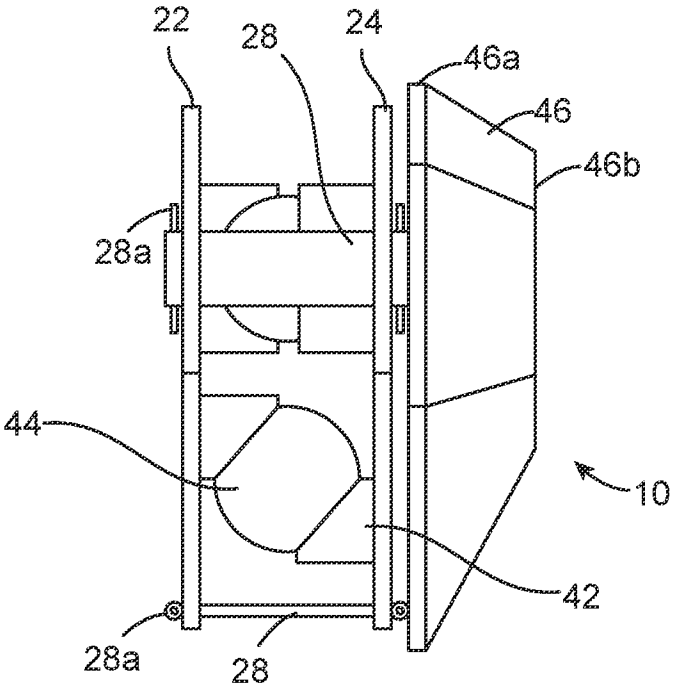
FIG. 2 shows a side view of the present invention 10. A second plate 24 is tethered a first plate 22 by a plurality of straps 28. Angled members 42 are attached to the second plate 24 and to the first plate 22 having shock absorbers 44 therebetween. A padding 46 is attached to a front side of the second plate 24.
Figure 3:
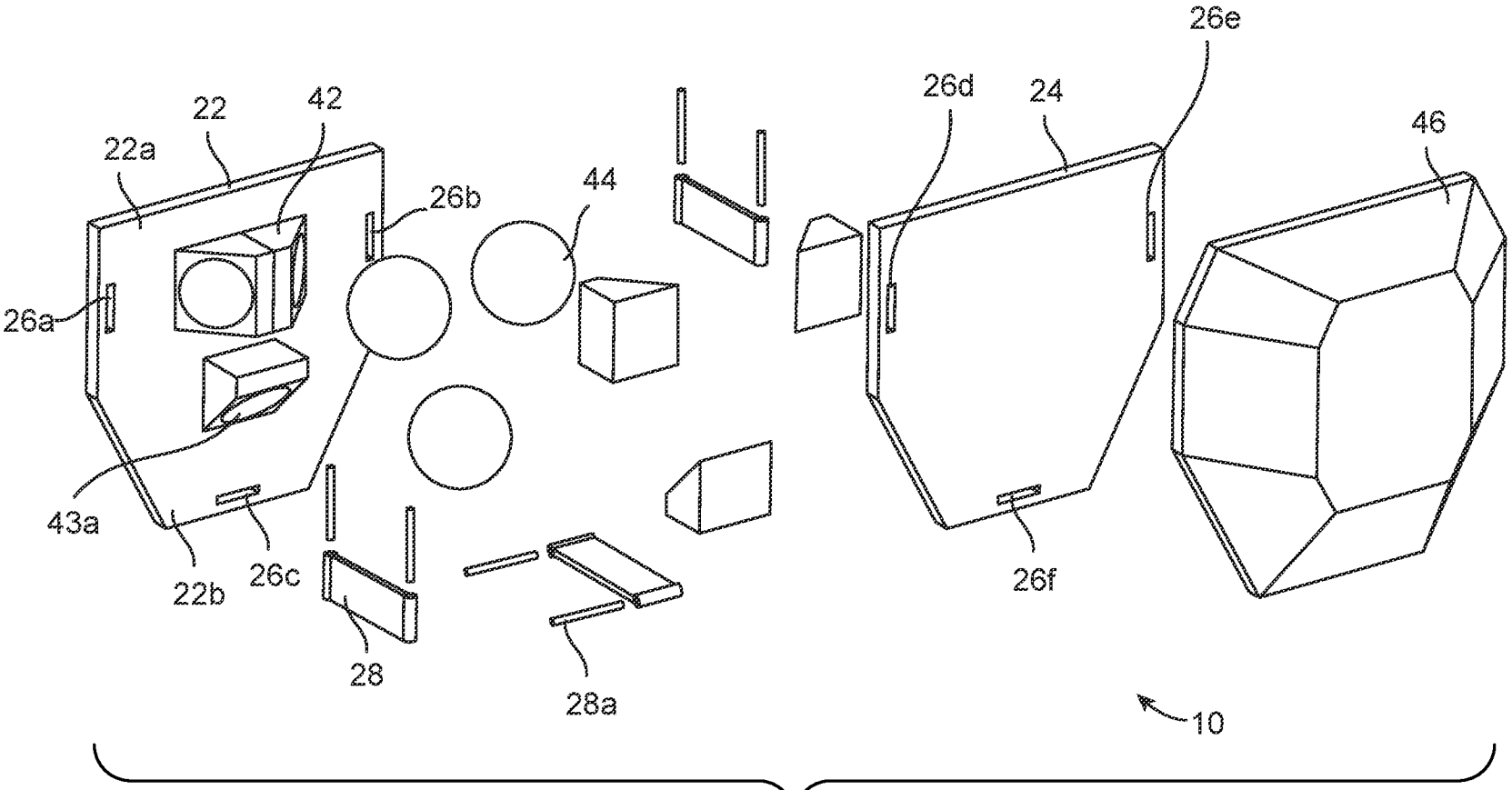
FIG. 3 illustrates an exploded view of the present invention 10.
Figure 4:
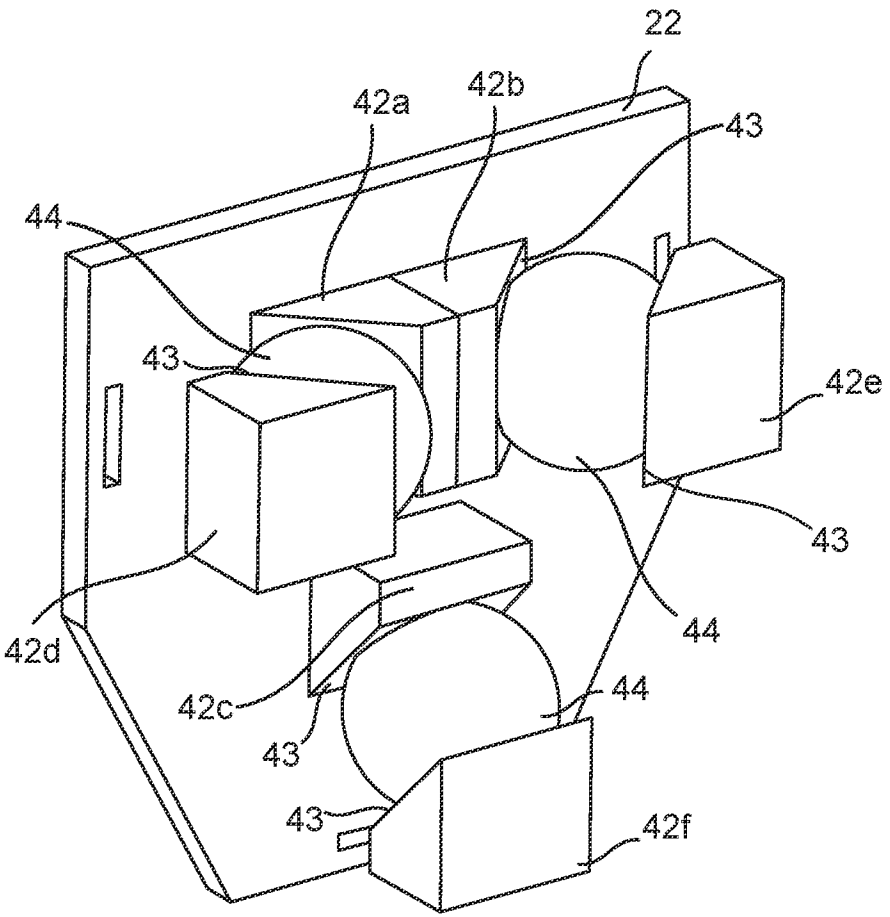
FIG. 4 is a representation of a detailed view of the shock absorbers 44 mounted to the first plate 22.

Referring now to the drawings, where the present invention is generally referred to with numeral 10, it can be observed that it basically includes a plates assembly 20, a damping assembly 40 and a wall assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The plates assembly 20 includes a first plate 22 and a second plate 24. The first plate 22 may have an upper portion 22*a* and a lower portion 22*b*. The upper portion 22*a* may have a rectangular shape. It should be understood that other shapes like circular, triangular or any other geometric shape may be suitable for the upper portion 22*a*. The lower portion 22*b* may have a trapezium isosceles shape. A bottom of the lower portion 22*b* corresponds to a short base of the trapezium isosceles shape. A top portion of the lower portion 22 corresponds to a major base of the trapezium isosceles shape. Other embodiments for the first plate 22 may include any other geometric shape. A front side and a back side of the first plate 22 may be flat. In a preferred embodiment, the first plate 22 may be made of wood. Wood has damping properties to dissipate vibrations. It also may be suitable for the first plate 22 to be made of steel, rigid plastic, or any other rigid material that can resist impacts. The first plate 22 may include openings 26. The openings 26 may be defined by rectangular cuts through portions of the front side of the first plate 22 to portions of the back side of the first plate 22. In one embodiment, the first plate 22 may include three openings 26. A first opening 26*a* may be located on a left portion of the upper portion 22*a*. A second opening 26*b* may be located on a right portion of the upper portion 22*a*. A third opening 26*c* may be located above the bottom of the lower portion 22*b*. The second plate 24 may have substantially same shape as the first plate 22. The second plate 24 may be made of wood, steel, rigid plastic, or the like. In one embodiment, the second plate 24 may include three openings 26. A fourth opening 26*d* may be located on a left portion of an upper portion of the second plate 24. A fifth opening 26*e* may be located on a right portion of the upper portion of the second plate 24. A sixth opening 26*f* may be located above a bottom of a lower portion of the second plate 24.

The damping assembly 40 includes angled members 42 and shock absorbers 44. Each of the angled members 42 may have a shape of a right trapezium wherein an inclined face 43 may include a cavity 43*a*. The cavity 43*a* may have a spherical shape. In a preferred embodiment, the angled members 42 may be made of wood. It also may be suitable for the angle members to be made of steel, plastic, or the like. Each of the shock absorbers 44 may have a spherical shape. Each of the shock absorbers 44 may have substantially the same radius as the radius of the cavity 43*a* of each of the angled members 43. In one embodiment, each of the shock absorbers 44 may be made of rubber, foam, or any other material with high damping properties to dissipate energy of impacts. In one embodiment, each of the shock absorbers 44 may include an interior cavity filled with air. It also may be suitable for the cavity of each of the shock absorbers 44 to be filled with a solid material such as rubber, foam or the like. It should be understood that the shock absorbers 44 can be easily replaced by shock absorbers with different damping properties for different types of training.

The front side of the first plate 22 may have angled members 42 attached thereon. A back side of the first plate 22 may also have angled members 42 attached thereon. In one embodiment, the front side of the first plate 22 may include three angled members 42. A first angled member 42*a* and a second angled member 42*b* can be located on a center portion of the of the upper portion 22*a*. A third angled member 42*c* may be located at a top portion of the lower portion 22*b*. The inclined face 43 of a fourth angled member 42*d* may be orientated opposite to the inclined face 43 of the first angled member 42*a*. The inclined face 43 of a fifth angled member 42*e* may be orientated opposite to the inclined face 43 of the second angled member 42*b*. The inclined face 43 of a sixth angled member 42*f* may be orientated opposite to the inclined face 43 of the third angled member 42*c*. The shock absorbers 44 may be located between the cavities of the angled members 42. It should be understood that the shock absorbers 44 alongside the angled members 42 may be arranged in any other configuration and within a plurality of plates. It should be understood that the shock absorbers 44 alongside the angled members 42 may absorb and dissipate the energy of any movement or force applied to the any other configuration.

The second plate 24 may be tethered to the first plate 22 via a plurality of straps 28. Each of the plurality of straps 28 may be made of synthetic or natural fibers. Each of the plurality of straps 28 may be deformable. Each of the plurality of straps 28 may include a strap opening in each distal end to receive a latch 28*a* therein. The latch 28*a* may be made of metal. The length of the latch 28*a* may be greater than the length of each of the openings 26. A first strap of the plurality of straps 28 may cross through the first opening 26*a* and through the fourth opening 26*d*. A second strap of the plurality of straps 28 may cross through the second opening 26*b* and through the fifth opening 26*e*. A third strap of the plurality of straps 28 may cross through the third opening 26*c* and through the sixth opening 26*f*.

A front face of the second plate 24 may include a padding 46. The padding may have a padding back side 46*a* and a padding front side 46*b*. The padding back side 46*a* may have a shape of a polygon of eight sides. The padding front side 46*b* may have a shape of a polygon of eight sides. The area of the padding back side 46*a* may be greater than the area of the area of the front face of the second plate 24. The area of the padding front side 46*b* is less than the area of the padding back side 46*a*. The padding back side 46*a* tapers towards the padding front side 46*b*. The padding 46 may be made of rubber, foam, or any other material with high damping properties and viscoelasticity properties to absorb and dissipate the energy of impacts.

Best observed in FIG. 1, the plates assembly 20 may be mounted to a wall 62 of a wall assembly 60 utilizing bolts. When a user impacts the present invention 10 the damping assembly 40 absorbs impact energy. After the user impacts the padding 46, the present invention is compressed from an initial position to a final position towards the wall 62. The damping properties of the damping assembly 40 let the present invention to return steady to the initial position. The damping assembly 40 may dissipate the impact energy.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for absorbing and redirecting impacts, comprising:

a) a plates assembly including a first plate, a second plate and a plurality of straps, wherein said second plate and said first plate include openings, each of the openings receive a corresponding strap of the plurality of straps, each strap of said plurality of straps includes a strap opening at each of a first and second end to receive a corresponding latch therein, said plurality of straps tether said second plate to the first plate; and b) a damping assembly including angled members, shock absorbers and a padding, wherein said angled members include a plurality of first members attached to a front side of said first plate and a plurality of second members attached to a back side of said second plate, each shock absorber being between a first member of the plurality of first members and a second member of the plurality of second members, said padding is attached to a front side of said second plate.

2. The system for absorbing and redirecting impacts of claim 1, wherein said first plate is attached to a wall.

3. The system for absorbing and redirecting impacts of claim 1, wherein said shock absorbers are made of rubber having an interior cavity filled with air.

4. The system for absorbing and redirecting impacts of claim 1, wherein said padding is made of rubber.

5. The system for absorbing and redirecting impacts of claim 1, wherein said shock absorbers are spherical.

6. The system for absorbing and redirecting impacts of claim 1, wherein said angled members include a spherical cavity to receive said shock absorbers therein.

7. The system for absorbing and redirecting impacts of claim 1, wherein said padding is bigger than said second plate.

8. The system for absorbing and redirecting impacts of claim 1, wherein said second plate and said first plate are made of wood.

9. The system for absorbing and redirecting impacts of claim 1, wherein said padding is configured to receive an impact.

10. The system for absorbing and redirecting impacts of claim 1, wherein said damping assembly is configured to absorb energy from an impact.

11. A system for absorbing and redirecting impacts, comprising:

a) a plates assembly including a first plate, a second plate and a plurality of straps, wherein said second plate and said first plate include openings, each of the openings receive a corresponding strap of the plurality of straps, each strap of said plurality of straps includes a strap opening at each of a first and second end to receive a corresponding latch therein, said plurality of straps tether said second plate to the first plate;

b) a damping assembly including angled members, shock absorbers and a padding, wherein said angled members include a plurality of first members attached to a front side of said first plate and a plurality of second members attached to a back side of said second plate, each shock absorber being between a first member of the plurality of first members and a second member of the plurality of second members, said padding is attached to a front side of said second plate;

c) said first plate is attached to a wall; and d) said damping assembly is configured to absorb and dissipate energy of impacts.

12. A system for absorbing and redirecting impacts consisting of:

a) a plates assembly including a first plate, a second plate and a plurality of straps, wherein said second plate and said first plate include openings, each of the openings receive a corresponding strap of the plurality of straps, each strap of said plurality of straps includes a strap opening at each of a first and second end to receive a corresponding latch therein, said plurality of straps tether said second plate to the first plate;

b) a damping assembly including angled members, shock absorbers and a padding, said angled members have an inclined face having a spherical cavity to receive said shock absorbers, said angled members include a plurality of first members attached to a front side of said first plate and a plurality of second members attached to a back side of said second plate, each shock absorber being between a first member of the plurality of first members and a second member of the plurality of second members, said padding is attached to a front side of said second plate;

c) said shock absorbers and said padding are made of rubber, said shock absorbers are spherical;

d) said padding includes a back padding side and a front padding side having a shape of a polygon of eight sides, said padding back side has a greater area than said second plate, said front padding side having less area than said padding back side, said padding tapers from said padding back side towards said padding front side;

e) said first plate is attached to a wall utilizing bolts, said first plate and said second plate are made of wood; and f) said damping assembly is configured to absorb and dissipate energy of impacts.

* * * * *